US011337562B2

(12) United States Patent
Russier et al.

(10) Patent No.: US 11,337,562 B2
(45) Date of Patent: May 24, 2022

(54) DEVICE FOR DISPENSING GEL OR LIQUID

(71) Applicants: Déric Russier, Saint Privat des Vieux (FR); Jonathan Russier, Saint Privat des Vieux (FR)

(72) Inventors: Déric Russier, Saint Privat des Vieux (FR); Jonathan Russier, Saint Privat des Vieux (FR)

( * ) Notice: Subject to any disclaimer, the term of this patent is extended or adjusted under 35 U.S.C. 154(b) by 0 days.

(21) Appl. No.: 16/989,482

(22) Filed: Aug. 10, 2020

(65) Prior Publication Data

US 2021/0298538 A1 Sep. 30, 2021

(30) Foreign Application Priority Data

May 18, 2020 (EP) ..... 20175274

(51) Int. Cl.
*A47K 5/12* (2006.01)
*B05B 9/04* (2006.01)
*B05B 12/00* (2018.01)

(52) U.S. Cl.
CPC ..... *A47K 5/1205* (2013.01); *B05B 9/0413* (2013.01); *B05B 12/002* (2013.01)

(58) Field of Classification Search
CPC ..... A47K 5/1205; A47K 5/14; B05B 9/0413; B05B 12/002; B05B 12/004; B05B 12/02
USPC ..... 222/71, 162–163, 333, 644–649, 222/180–183, 173–175, 179, 186, 383.1, 222/190
See application file for complete search history.

(56) References Cited

U.S. PATENT DOCUMENTS 1,794,484 A * 3/1931 Seidel ..... F16K 31/62 222/179
1,939,981 A * 12/1933 Hillyard ..... A47K 5/1214 222/179
1,949,315 A 2/1934 Levernier
2,292,749 A * 8/1942 Feinson ..... A47K 5/1205 222/179

(Continued)

FOREIGN PATENT DOCUMENTS

EP 2695548 A1 2/2014

OTHER PUBLICATIONS

STIC Search of Patent References ordered by and reviewed by examiner dated Mar. 7, 2021, the STIC Search is attached (Year: 2021).*

(Continued)

*Primary Examiner* — Vishal Pancholi
(74) *Attorney, Agent, or Firm* — Patshegen IP LLC; Moshe Pinchas

(57) ABSTRACT

The device for dispensing gel or liquid contained in a container comprising a reservoir provided with a pump set in motion relative to the reservoir, comprises a body. The body comprises in the lower part, an actuating pedal and at the top, above a support for a reservoir of said container, a space for receiving any gel or liquid container having dimensions less than predetermined maximum dimensions. The body also comprises a piston for transferring the vertical movement of the pedal to the reservoir support, setting the reservoir in upward movement under the action of the pedal, and a stop for retaining the pump of the container provided with a pouring spout. The pump causes a part of the gel or liquid contained in the reservoir to be expelled when the reservoir is moved by the action of the pedal.

14 Claims, 11 Drawing Sheets

(56) References Cited

U.S. PATENT DOCUMENTS 2,456,958 A * 12/1948 Kretschmer ..... G01F 11/08 222/209
2,488,266 A * 11/1949 Brenn ..... A47K 5/1205 222/179
2,494,147 A * 1/1950 Trelease ..... A01K 39/06 222/179
2,673,008 A * 3/1954 Ryan ..... A47J 47/16 222/162
2,904,223 A * 9/1959 Ryan ..... B65D 83/386 222/162
3,090,528 A * 5/1963 Ellis ..... A47K 5/06 222/179
3,203,597 A * 8/1965 Birch ..... A47K 5/1204 222/179
3,233,787 A * 2/1966 Ross ..... A47K 5/1205 222/179
3,516,424 A * 6/1970 Eagle ..... A46B 11/0017 132/148
3,952,916 A * 4/1976 Phillips ..... B65D 83/262 222/645
4,084,729 A * 4/1978 Epple ..... G01F 11/025 222/307
4,187,845 A * 2/1980 Dror ..... A61M 16/0057 128/205.13
4,606,085 A 8/1986 Davies
4,880,161 A * 11/1989 Wright ..... B05B 11/3052 239/330
5,269,444 A * 12/1993 Wright ..... B01F 3/04446 222/190
5,413,152 A * 5/1995 Burrows ..... B67D 3/0032 141/18
5,676,278 A * 10/1997 Beyer ..... B67D 3/0029 222/185.1
5,829,642 A * 11/1998 Momboisse ..... B05B 11/3056 222/162
5,897,031 A * 4/1999 Wirt ..... A47K 5/1204 222/179
6,663,307 B2 * 12/2003 Kopanic ..... A01M 7/00 222/174
6,708,845 B2 * 3/2004 Weng ..... A47K 10/32 222/135
8,087,543 B2 * 1/2012 Yang ..... A47K 5/1217 222/52
8,573,443 B2 * 11/2013 Natterer ..... B05B 12/122 222/52
8,893,320 B2 * 11/2014 Klicpera ..... G01F 15/075 4/615
9,763,546 B2 * 9/2017 Yang ..... A47K 5/1217
10,337,662 B1 * 7/2019 Gradillas ..... E03C 1/18
2005/0072808 A1 * 4/2005 Kitamura ..... B05B 11/3008 222/309
2006/0118577 A1 * 6/2006 Mineau ..... B65D 83/205 222/174
2009/0194563 A1 * 8/2009 Lewis ..... A47K 5/14 222/1
2010/0084434 A1 * 4/2010 Rhoades ..... B65D 83/386 222/162
2011/0132931 A1 * 6/2011 Wright ..... A47K 5/14 222/173
2015/0022361 A1 1/2015 Gaisser et al.
2016/0033118 A1 * 2/2016 Remus ..... F16M 11/28 362/418
2019/0261817 A1 * 8/2019 Wertheim ..... A47K 5/12

OTHER PUBLICATIONS

STIC Search of Non-Patent Literature ordered by and reviewed by examiner dated Mar. 7, 2021, the STIC Search is attached (Year: 2021).*

* cited by examiner

DEVICE FOR DISPENSING GEL OR LIQUID

TECHNICAL FIELD OF THE INVENTION

The present invention relates to a device for dispensing gel or liquid. It applies, in particular, to the field of equipment in collective or public places, such as offices, factories, shops, restaurants and official establishments. More particularly, this invention applies to dispensing hydroalcoholic gel for hand disinfection or to dispensing food ingredients, sauces, mayonnaise, ketchup, and the like.

STATE OF THE ART

The known gel dispensers are of three types. Personal dispensers, which are vials with a finger-operated dispensing head, are stolen if they are made available to the public. And the very fact of handling them can contaminate them and cause contamination of other users. Wall-mounted dispensers have two disadvantages. First, they are only compatible with one type, and usually one brand, of gel container. Secondly, handling them requires touching a part of the container, which can become contaminated. Their use is therefore costly since a specific delivery of containers must be provided for and the lack of competition generally increases the unit cost of the containers. Wall-mounted electrical dispensers, for example, equipped with a one-handed presence detector and a motorized spout, require either a stand-alone power source or a connection to the electrical grid. They are therefore expensive to install and operate.

In addition, to be sure that a person accessing a room has properly disinfected his hands, it is necessary to place a guard, who may or may not authorize the person's access to the room. Some automatic soap dispensers have a pump that is activated after the presence of a hand is detected. These products are slow, with a reaction time of more than one second.

DISCLOSURE OF THE INVENTION

The present invention is intended to remedy all or some of these disadvantages.

To this end, according to a first aspect, the present invention relates to a device for dispensing gel or sanitary liquid, that comprises a body comprising:

- at a lower part of the body, an actuating pedal, which is movable about an axis of rotation and has an inner part which is located, relative to the outer part, on the other side of the axis of rotation, the inner part being moved up into the interior of the body when the pedal is pressed and the outer part moves down,
- inside an upper part of the body, a space for receiving a gel or liquid container comprising a head actuating a pump and a tank, on a container tank support,
- inside the body and between the lower part and the upper part of the body, a piston or rod for transferring a vertical movement of the inner part of the pedal to the tank support, setting the tank in upward movement when the pedal is pressed,
- a stopper for holding the container head stationary when the tank is set in upward movement;

wherein the body is cylindrical and performs at least the following three functions:

- external wall of the device,
- sliding guide of the container tank support inside the body,
- wall which holds the container with the container head held against the retaining stop, this wall and the retaining stop together preventing the bottle from being removed;

and wherein the container head, which actuates the pump, remains stationary against the stopper and the container tank moves towards the container head with the upward movement of the container tank support to pressurize the gel or liquid inside the container and cause a portion of this gel or liquid to be expelled.

Thanks to these provisions, the device is very simple and completely mechanical and does not require any energy source. Moreover, the user does not have to touch the device except with the foot that operates the pedal. There is therefore no risk of the device becoming contaminated during use. The device is compatible with all containers that can fit over the holder.

Preferably, the space for receiving a container is configured to receive any container up to a predetermined maximum width, e.g., 150 mm. and a predetermined maximum height, e.g., 300 mm.

It is noted here that cylindrical surface is a surface consisting of all the points on all the lines which are parallel to a given line and which pass through a fixed plane curve in a plane not parallel to the given line. Any line in this family of parallel lines is called an element of the cylindrical surface. From a kinematics point of view, given a plane curve, called the directrix, a cylindrical surface is that surface traced out by a line, called the generatrix, not in the plane of the directrix, moving parallel to itself and always passing through the directrix. Any particular position of the generatrix is an element of the cylindrical surface. A solid bounded by a cylindrical surface is cylindrical.

In embodiments, the stop for retaining the container head is removable and provided with a locking means, wherein unlocking of the locking means allows passage and replacement of the container.

In embodiments, the device comprises a piston provided with a lower part in the form of a piston guide and configured to slide on the inner wall of the body.

In embodiments, the device for dispensing gel or liquid also comprises a support plate on the floor and/or wall supporting the body of the device. Thanks to these provisions, the device cannot be stolen and can be supported or fixed to the floor and/or the wall.

In embodiments, the body has a lateral opening around the stop, configured to allow several fingers of a user to pass under the spout of the gel or liquid container. Thanks to these provisions, to receive the gel or liquid, the user is not in danger of touching and thus contaminating part of the device or container.

In embodiments, the stop is removable and provided with a locking means. Thanks to these provisions, the public cannot access the container and steal it, on the one hand, but an operator can easily unlock the stop and replace an empty container.

In embodiments, the piston is equipped with internal body guides, which are configured to slide on the inside wall of the body. Thanks to these provisions, the piston is free to slide in the body without risk of jamming.

In embodiments, the body has an opening facing the container. Thanks to these provisions, an operator can see the filling level of the container. Preferably, the opening is closed by a glass pane or is not on the pedal side so as not to encourage a child to put his fingers in it.

In embodiments, the piston or rod has a means of adjusting its length between the pedal and the tank support. Thanks to these provisions, when changing the height of the container, the length of the piston is adjusted so that the movement of the container support causes the pump to be actuated by the movement of the container tank.

In embodiments, the adjusting means is a combination of a screw associated with one part of the piston and a thread formed in another part of the piston.

In embodiments, the adjusting means comprises a key carried by one part of the piston, which penetrates into one of a plurality of orifices carried by another part of the piston at different distances from one of its ends.

In embodiments, the adjusting means comprises means for restraining the movement of the piston in its direction of movement towards the container by pinching a rod or linkage of the piston. Thanks to these provisions, the piston can have any length within a predetermined range of lengths.

In embodiments, the piston has a position indicator visible from outside the device.

This indicator, for example a ruler moving in front of an opening in the device or a lug protruding from an opening formed in the body of the device, allows an operator to visualize the filling level of the container.

In embodiments, the device comprises a container spout extension.

In embodiments, the plate comprises elements for fixing to the floor and/or wall. Thanks to these provisions, the device can be made non-removable and therefore uninhabitable.

In embodiments, the device has a larger dimension of between 90 cm and 110 cm. Thanks to these provisions, the delivery of the gel or liquid is done at the height of one hand with a substantially horizontal arm for the average height of adults and adolescents.

In embodiments, the piston forms a rod between the pedal and the container support.

In embodiments, the body is cylindrical and closed outside the pedal passage opening and the delivery opening for the gel or liquid.

In embodiments, the device further comprises a means for transmitting information representative of a movement of the pedal According to a second aspect, the present invention relates to a device for access to a place, which comprises a device for dispensing gel or liquid as described above, a receiver of information representative of the movement of the pedal, and means for inhibiting an access actuator configured to disable the actuator for a predetermined period of time following the movement of the pedal.

According to a third aspect, the present invention relates to a device for dispensing gel or liquid, which comprises:

- a support plate on the floor and/or on the wall,
- a body supported by the plate comprising, in the lower part, a pedal for actuating a pump connected, on the one hand, to a gel or liquid tank and, on the other hand, to a pipe for raising the gel or liquid pumped, the pipe opening out in the upper part of the body.

Thanks to these provisions, the device is completely mechanical and does not require any energy source. Moreover, the user does not have to touch the device, except with the foot that operates the pedal. There is therefore no risk of the device becoming contaminated during use. The device cannot be tampered with and can be fixed to the floor and/or wall.

In embodiments, the body has an opening facing the tank. Thanks to these provisions, an operator can see the tank filling level. Preferably, the opening is closed by a window or is not on the side of the pedal so as not to encourage a child to put his fingers in it.

In embodiments, the plate is fitted with floor and/or wall mounting elements. Thanks to these provisions, the device can be made non-removable and therefore uninhabitable.

In embodiments, the device has a larger dimension of between 90 cm and 110 cm. Thanks to these provisions, the delivery of the gel or liquid is done at the height of one hand with a substantially horizontal arm for the average height of adults and adolescents.

In embodiments, the body is cylindrical and closed outside the pedal passage opening and the gel or liquid delivery opening.

In embodiments, the liquid or gel tank is made of:

- a cap provided with a distributor connection passage defining a translation axis, the cap having a first part of a first retaining means,
- a passage obturator mounted on the plug and comprising
  - a second part of the first means of restraint, complementary to the first part of the first means of restraint, and
  - a first part of a second retaining means on a coupling head comprising a second part of the second retaining means complementary to the first part of the second retaining means, the restraint means being configured:

- to engage and disengage by translation along the axis of translation,
- so that the engagement force of the second restraining means is less than the disengagement force of the first restraining means, and
- so that the engagement force of the first means of restraint is less than the disengagement force of the second means of restraint.

Thanks to these provisions, when the tank is filled, for transport or before it is mounted on the distributor connection, the obturator is fixed on the cap and the tank is hermetically sealed. When the tank is mounted on the distributor fitting, the distributor fitting engages in the valve and then disengages the valve from the cap by moving the valve through the connection passage. When the tank is to be removed, even when partially or completely full, by sliding the coupling in the opposite direction, the valve engages in the cap and the coupling disengages from the valve. Moreover, if you want to refill the tank, you have to separate the obturator from the cap, so that the obturator falls to the bottom of the tank and does not re-engage with the cap. The contents of the tank can therefore be traced.

At least a part of at least one retaining means has at least one edge tooth perpendicular to the axis of translation, said tooth having a smaller angle to the axis of translation on the side of the tooth used for engagement than on the side of the tooth used for disengagement. Thanks to these provisions, the realization of the retaining means is facilitated and of low cost.

In embodiments, at least part of at least one means of restraint comprises a tooth with a frustoconical face. This truncated cone facilitates the engagement of the means of restraint.

In embodiments, at least part of at least one retaining means comprises a tooth with one face substantially in a plane perpendicular to the axis of translation. This planar face increases the force to be provided to disengage the retaining means.

In embodiments, at least part of at least one retaining means comprises a tooth having a truncated torus face. This truncated torus facilitates the engagement of the restraint.

In embodiments, at least part of at least one retainer has a receptacle for a tooth.

In embodiments, the mouth of the tank comprises a first part of a third retaining means and the cap comprises a second part of the third retaining means complementary to the first part of the retaining means.

According to a fourth aspect, the present invention relates to a distributor fitting for assembly with a tank as described above, which comprises a part of a retaining means, at least one seal and at least one channel for the passage of gel or liquid, which channel opens between the part of the retaining means and the seal.

According to a fifth aspect, the present invention relates to a device for dispensing gel or liquid, which comprises:

- a fitting as described above,
- a floor and/or wall support plate, and
- a body supported by the plate comprising, in the lower part, a pedal for actuating a pump connected, on the one hand, to a gel or liquid tank and, on the other hand, to a pipe for raising the gel or liquid pumped, the pipe opening out in the upper part of the body.

Thanks to these provisions, the device is completely mechanical and does not require any energy source. Moreover, the user does not have to touch the device, except with the foot that operates the pedal. There is therefore no risk of the device becoming contaminated during use. The device cannot be tampered with and can be fixed to the floor and/or wall. In embodiments, the dispenser comprises a tank which is a subject of the invention.

Since the advantages, purposes and particular characteristics of this dispenser and of this connection are similar to those of the tank which is a subject of the invention, they are not recalled here.

The present invention relates, according to a sixth aspect, to a device for the automatic dispensing of liquid, which comprises:

- a body supported by the plate comprising a product tank provided with an outlet pipe,
- a pump on the outlet line, configured to pump the product,
- a pocket of pressurized liquid downstream, on the pipe, of the pump,
- an electric valve downstream of the bag, followed by a liquid ejection opening,
- a sensor for detecting the presence of a hand in the axis of the ejection opening, and
- a circuit for controlling the electric valve which opens the electric valve for a first predetermined period of time upon detection of a hand by the sensor and for controlling the pump for a second predetermined period of time after detection of a hand by the sensor.

Thanks to these provisions, a reserve of liquid is constantly under pressure in the bag so that the ejection of a dose is very fast and allows dispensing liquid to a large number of successive users, for example at the entrance to a public place such as a public transport network building or a public transport vehicle or a shop. In addition, compared to pressurising the entire tank, the risk of explosion in the event of a leak in the pressurised part is limited by the small volume under pressure. And some liquids are flammable, e.g. hydroalcoholic gel.

In embodiments, the difference between the volume of the pressure bag and its volume if the electric valve is permanently open is less than 12 ml.

This useful volume (volume corresponding to the volume of liquid that can be dispensed) corresponds to at least four recommended doses (3 ml) for the hygienic treatment and surgical disinfection of hands with hydroalcoholic gel. Thus, even if several people follow one another very quickly to obtain liquid, the pouch is able to provide the required doses very quickly.

The second predetermined pump operating time is preset to complete the filling of the pouch in less than two seconds after a first predetermined time of opening the electric valve.

Thanks to these provisions, even if the dispenser is under heavy load, every two seconds a dose can be delivered to a user.

In embodiments, the control circuit comprises means for estimating the pressure in the pressure bag and/or the useful volume of liquid available in the pressure bag, and the control circuit is configured to determine the first predetermined time according to a decreasing function of the estimated pressure in the pressure bag and/or of the useful volume.

Thanks to these provisions, the ejection flow rate being higher when the pressure and/or the useful volume is higher, this higher flow rate is compensated for by a first lower duration. As a result, the volume of liquid dispensed to each successive user is substantially constant.

The device also comprises, in embodiments, a means for transmitting information representative of the opening of the electric valve or movement of the pedal.

Thanks to these provisions, by transmitting information representative of the distribution of liquid, the device allows the control of an access, for example the disengagement of a lock or an electric strike or the activation of motors for opening a sliding or pivoting door.

In embodiments, the device comprises a means for transmitting information representative of the level of liquid in the tank. Thanks to these provisions, an operator can be warned that the tank of the device needs to be refilled or replaced.

The means for transmitting information representative of the level is configured to count the number of openings of the electric valve from the supply. Thanks to these provisions, the available liquid level can be estimated indirectly.

In embodiments, the means of transmission of information representative of the level comprises a pressure or force sensor positioned in a support of the tank. Thanks to these provisions, the liquid level can be estimated precisely, without the circuit needing to know that a supply has taken place.

In embodiments, the means of transmitting information representative of the liquid level in the tank is configured to transmit this information only when the estimated level is below a predetermined value.

In embodiments, the means for transmitting information representative of the liquid level in the tank is configured to measure an average daily consumption of liquid, the predetermined value being this average daily consumption multiplied by a predetermined number of days.

Thanks to these provisions, the operator always has the same time to intervene, whatever the actual daily consumption of liquid.

In embodiments, the device further comprises:

a temperature sensor supported at the average height of the user's head by an arm connected to the body, this temperature sensor being configured to estimate the temperature of the user's forehead, a circuit being configured to, in the event that this temperature is higher than a predetermined value, transmit an alert or alarm.

Thanks to these provisions, access to a place can be refused to a user with a fever.

According to a seventh aspect, the present invention relates to a device for access to a place, which comprises a dispensing device which is a subject of the invention, a receiver of information representative of the opening of the electric valve, and means for inhibiting an access actuator configured to disable the actuator for a predetermined period of time following depression of the opening of the electric valve.

The advantages, purposes and characteristics of said access device being similar to those of the dispensing device which is the subject of the invention.

The different aspects of the invention and their particular features are to be combined to form gel or liquid dispensing devices having the advantages of these different aspects.

BRIEF DESCRIPTION OF THE FIGURES

Other advantages, purposes and special features of the invention shall be apparent from the following non-exhaustive description of at least one particular embodiment of a dispensing device, a distributor fitting and a device for access to a place according to the invention, in relation to the drawings annexed hereto, in which.

DESCRIPTION OF EXAMPLES OF HOW THE INVENTION HAS BEEN MADE

Figure 1:
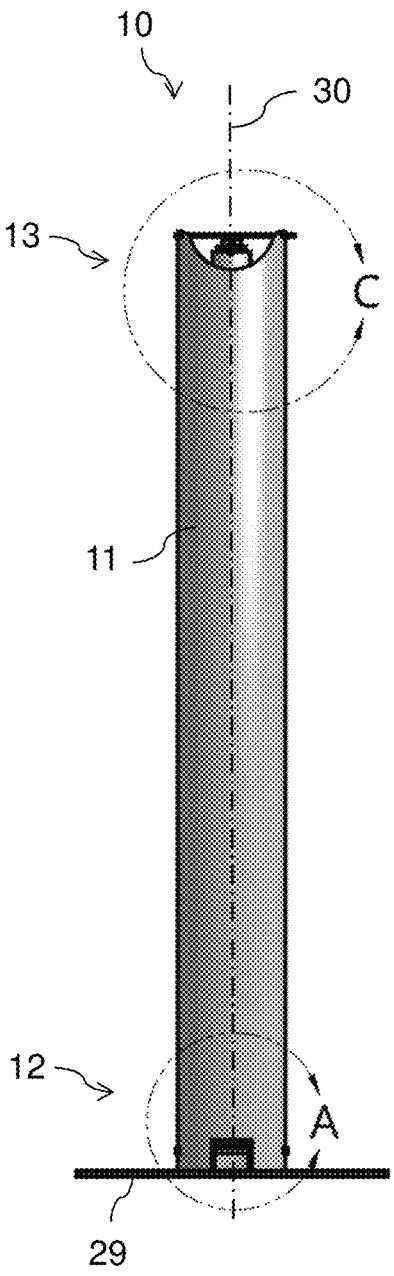
FIG. 1 represents, in elevation and in front view, a particular embodiment of the dispensing device which is a subject of the invention.

This description is given as a non-exhaustive list, as each characteristic of one embodiment may be combined with any other characteristic of any other embodiment in an advantageous manner. It should be noted that the figures are each to scale and that the scales of the different figures may be different.

Throughout the description, "upper" or "top" is used to refer to that which is at the top, or facing upwards, in FIGS. 1 to 3, 5 to 11 and 14 to 19, which correspond to the normal operating configuration of dispenser. Lower" or "bottom" is used to refer to what is down or facing down in these figures. The concepts of vertical and horizontal are derived from these definitions. "Internal" means close to or oriented towards a vertical longitudinal axis 30, 60 and 111 of the device and "external" means oriented away from that vertical axis. The height of the device is defined according to this vertical axis. Throughout the present specification, a system that dispenses the contents of a container is referred to interchangeably as a dispenser, a dispensing device or a distribution device. Throughout the present specification, the words "reservoir" and "tank" have the same meaning.

In FIGS. 1 to 7, a gel or liquid dispensing device 10 is represented. This device comprises

- in the lower part, an actuating pedal 14,
- at the top, a space 31 for receiving a gel or liquid container 19 on a container tank support 18,
- a piston 17 or rod for transferring a vertical movement of the pedal to the tank support, setting the tank in upward movement under the action of the pedal, and
- a stop 21 for holding a pump 27 of the container stationary when the tank is set in upward movement, said pump being provided with a pouring spout 20, which pump causes a part of the gel or liquid contained in the container to be expelled when the tank is moved by the action of the pedal.

Figure 2:
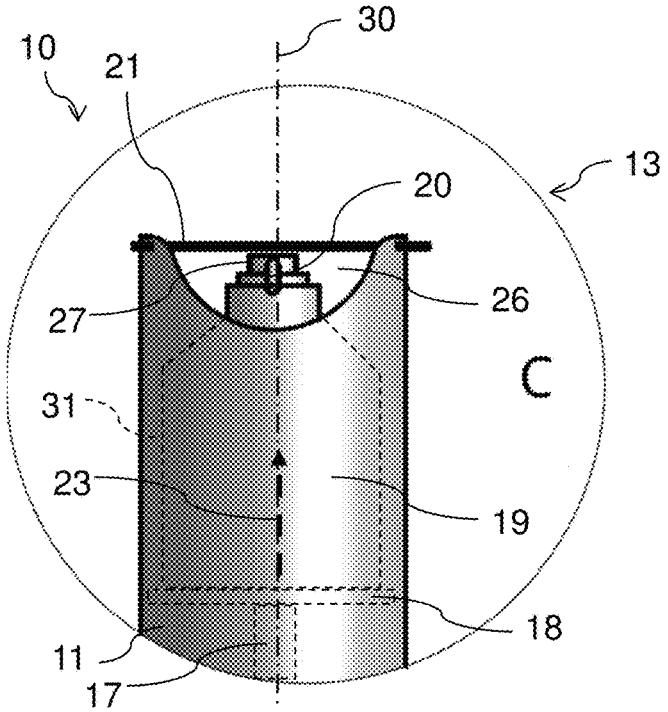
FIG. 2 is an enlargement of the upper part of the device shown in FIG. 1.
Figure 3:
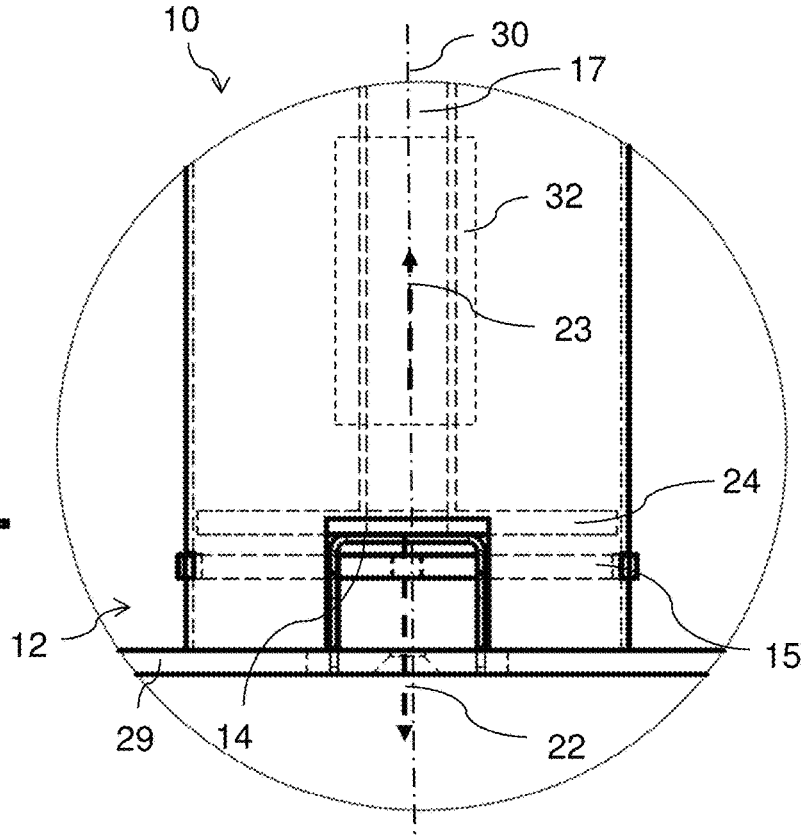
FIG. 3 is an enlargement of the lower part of the device shown in FIG. 1.
Figure 4:
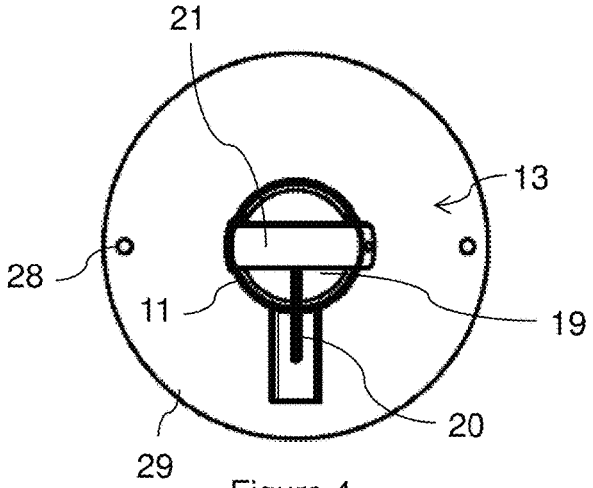
FIG. 4 is a top view of the device shown in FIGS. 1 to 3.
Figure 5:
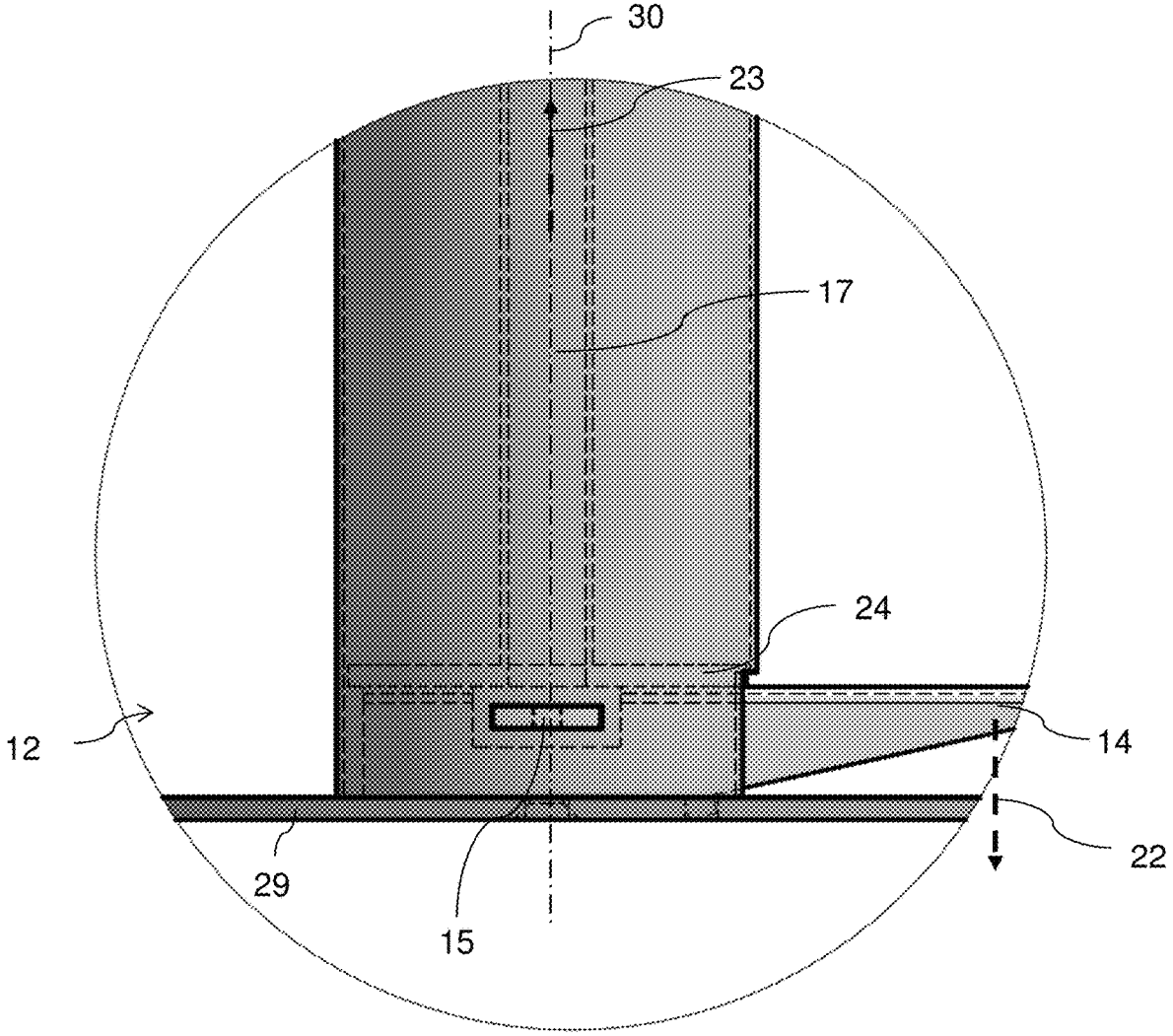
FIG. 5 is a side view of the lower part of the device shown in FIGS. 1 to 4.
Figure 6:
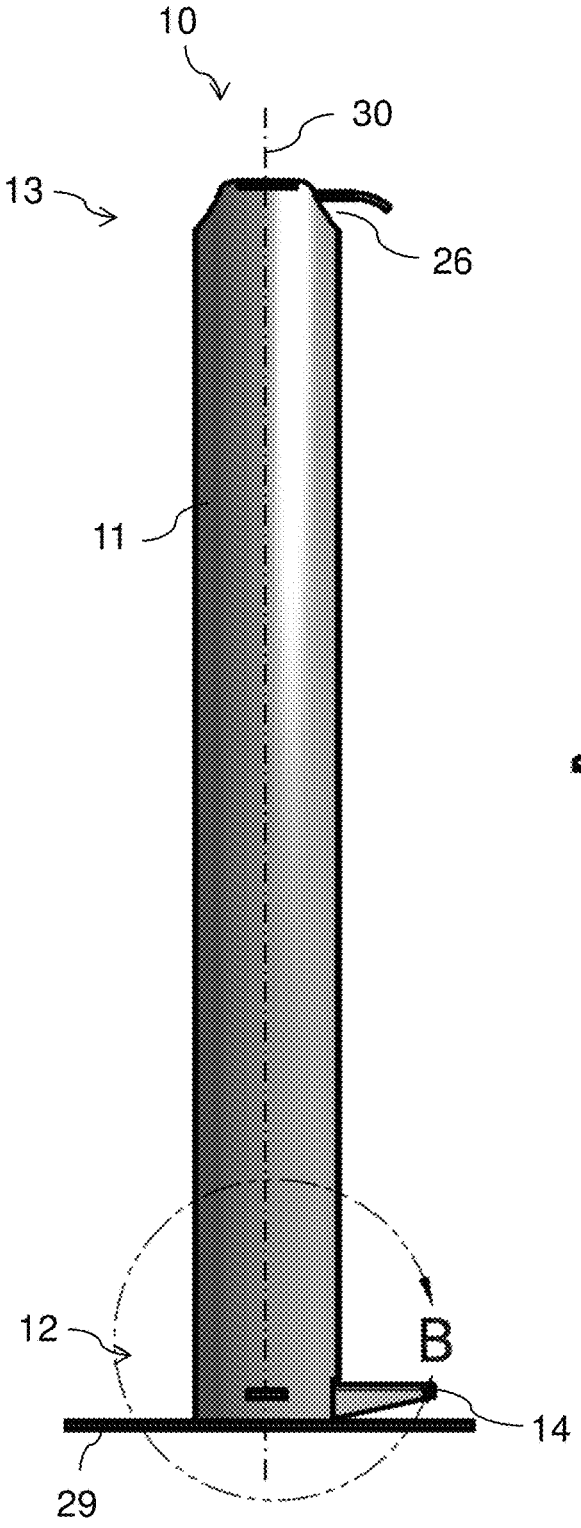
FIG. 6 is a side view of the entire device shown in FIGS. 1 to 5.
Figure 7:
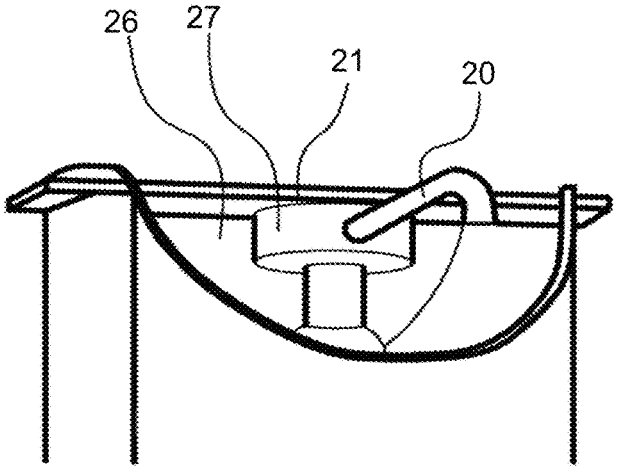
FIG. 7 is a perspective photograph of the upper part of the device shown in FIGS. 1 to 6.

In the embodiment shown in FIGS. 1 to 7, the device 10 comprises a ground support plate 29. In some variants, the plate is used as a means of anchoring to a wall or to the floor and wall. A body 11 is supported by the plate 29. The body 11 connects a lower part 12, at the height of a user's feet, and a higher part 13, at the height of a user's hands. The lower part 12 has an actuating pedal 14 extending outside the body 11 to receive the vertical downward action (from top to bottom as shown by arrow 22 in FIG. 3) of a user's foot and extending inside the body 11 to a horizontal axis of rotation 15. As a result of the support of the user's foot, the inner part of the pedal 14 which is, in relation to the outer part, on the other side of the axis of rotation 15 rises inside the body 11. A lower part 24 of a piston 17, resting on this part of the pedal 14, thus describes an upward movement, as illustrated by arrow 23. The piston 17 transmits this upward movement to a support 18 of a container 19 of gel or liquid, as shown in FIG. 2. Thus, the body 11 has, in its interior; a piston 17 transferring the movement of the pedal 14 to a support 18 of a container 19 of gel or liquid set in motion by the piston 17 under the action of the pedal 14.

A stop 21, in the upper part 13 of device 10, retains the container 19 inside the body 11 of device 10. The stop 21 for retaining container 19 is configured to, during the movement of container 19, pressurize the gel or liquid inside container 19 and cause a part of this gel or liquid to be expelled.

The body 11 is cylindrical and performs at least the following three functions:

- external wall of the device 10, sliding guide of the container tank support 18 inside the body, wall which holds the container with the container head held against the retaining stop 21, this wall and the retaining stop 21 together preventing the bottle from being removed. To release the container, the body 11 has to be opened, for example by removing the stop 21 or opening a door provided in the body.

In the embodiment shown in FIGS. 1 to 7, container 19 is a vial equipped with a pump 27 in a known manner. In this type of vial, pressing this pump with the finger or palm causes a dose of gel or liquid to be ejected. It is noted that other ejection or spray heads, known to the man in the trade, exist. In the embodiment shown, the head of the bottle, which operates the pump, remains stationary in abutment against stop 21 and the container 19 moves towards the pump with the vertical upward movement of holder 19. The pump is thus actuated and releases gel or liquid from the container 19 tank.

As can be understood, device 10 is completely mechanical and does not require any energy source. In addition, the user does not have to touch device 10 except with the foot that operates the pedal. There is therefore no risk of the device becoming contaminated during use. Device 10 may not be tampered with, in particular if it is fixed to the floor or wall. Device 10 is compatible with all containers capable of holding in body 11 above bracket 18.

In embodiments such as the one shown, body 11 has, around the stop 21, a lateral opening 26 configured to allow several fingers of a user to pass under a spout 20 of container 19. Thus, to receive the gel or the liquid, the user does not risk touching and thus contaminating a part of the device 10 or the container 19. Preferably, the stop 21 is removable and provided with a locking means (not shown). This locking means can be a nut, a padlock, for example. This prevents the public from accessing and stealing container 19, but an operator can easily unlock stop 21 and replace an empty container 19.

In embodiments such as the one shown, piston 17 is equipped with guides internal to body 11, guides consisting of the lower parts 24 and support 18, guides that are configured to slide on the inner wall of body 11. For example, body 11 is cylindrical and the lower part 24 and the support 18 rest on the walls of body 11, with a clearance that allows them to slide freely in body 11. The piston is thus free to slide in the body without risk of jamming.

In embodiments (not shown), the body 11 has an opening facing the container 19. An operator can thus see the filling level of container 19. Preferably, the opening is closed by a glass pane or is not on the side of the pedal 14 so as not to incite a child to put his fingers in it.

Preferably, the piston or rod has a means 32 of adjusting the piston 17 length between the pedal 14 and the tank support 18. In embodiments, the adjusting means 32 comprises a combination of a screw associated with one part of the piston and a thread formed in another part of the piston. In embodiments, the adjusting means 32 comprises a key carried by one part of the piston, which penetrates into one of a plurality of orifices carried by another part of the piston at different distances from one of its ends. In embodiments, the adjusting means 32 comprises means for restraining the movement of the piston in its direction of movement towards the container by pinching a rod or linkage of the piston. The piston 17 is thus incrementally advanced and can progressively compress a pocket 19 of gel or liquid present above the support 18. The person skilled in the art can be inspired by glue or putty guns to make this type of piston with incremental advance.

In embodiments (not shown), the piston 17 has a position indicator visible from outside the device 10. This indicator, for example a ruler moving in front of an opening of device 10 (for example opening 26 or an opening symmetrical with respect to the axis 30) or a lug projecting from an opening formed in the body of device 10, enables an operator to visualize the filling level of the container 19, in particular in the case of a pocket.

In embodiments (not shown), device 10 has a spout extension 20 of container 19. This extension, e.g. a hose, is force-fitted to the spout and allows gel or liquid to be dispensed over the outside of the body 11.

In the illustrated versions, the plate 29 is equipped with floor fixing elements 28. These fixing elements are conical screw head housings. By means of these arrangements, the device 10 can be made immovable and therefore unremovable.

Preferably, device 10 has a larger dimension, its height being between 90 cm and 110 cm. Thus, the delivery of the gel or the liquid is done at the height of one hand with a substantially horizontal arm for the average height of adults and adolescents.

In embodiments (not shown), the piston forms a rod between the pedal and the support 18 of container 19. In embodiments, the body is cylindrical and closed outside the pedal passage opening and the opening for dispensing the gel or liquid.

For example, the parts of device 10 are made of brushed stainless steel. This device is self-stable, vandal-proof and very resistant, it adapts to all standard bottles and flasks.

For example, the dimensions of device 10 are:

Height: 1000 mm

Body diameter 11: 114 mm

Plate diameter 29: 330 mm

Maximum container width, e.g., diameter, 110 mm

Maximum container height: 300 mm

Figure 8:
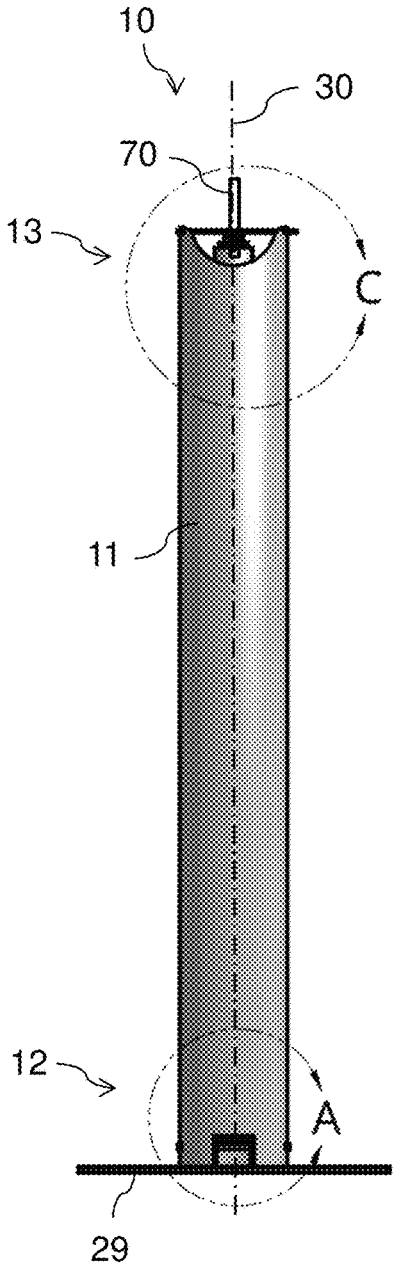
FIG. 8 represents, in elevation and front view, an embodiment of a dispensing device.
Figure 9:
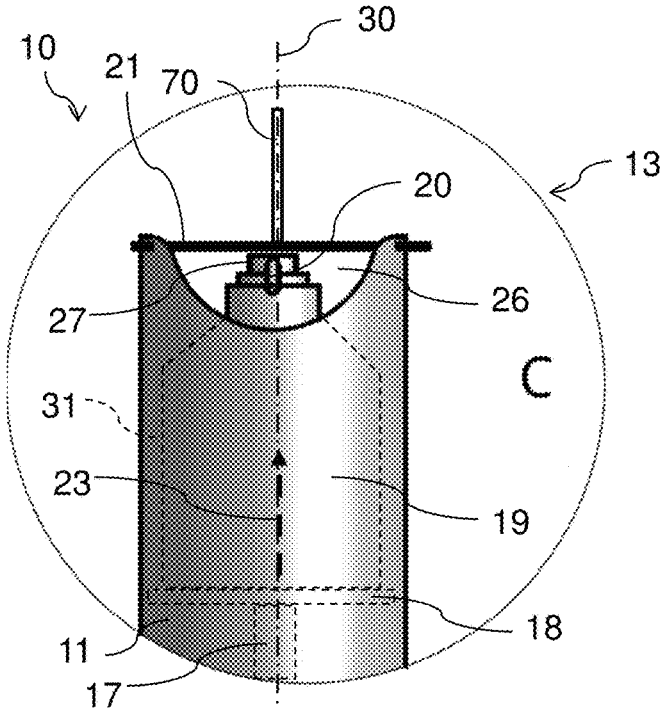
FIG. 9 is an enlargement of the upper part of the device shown in FIG. 8.
Figure 10:
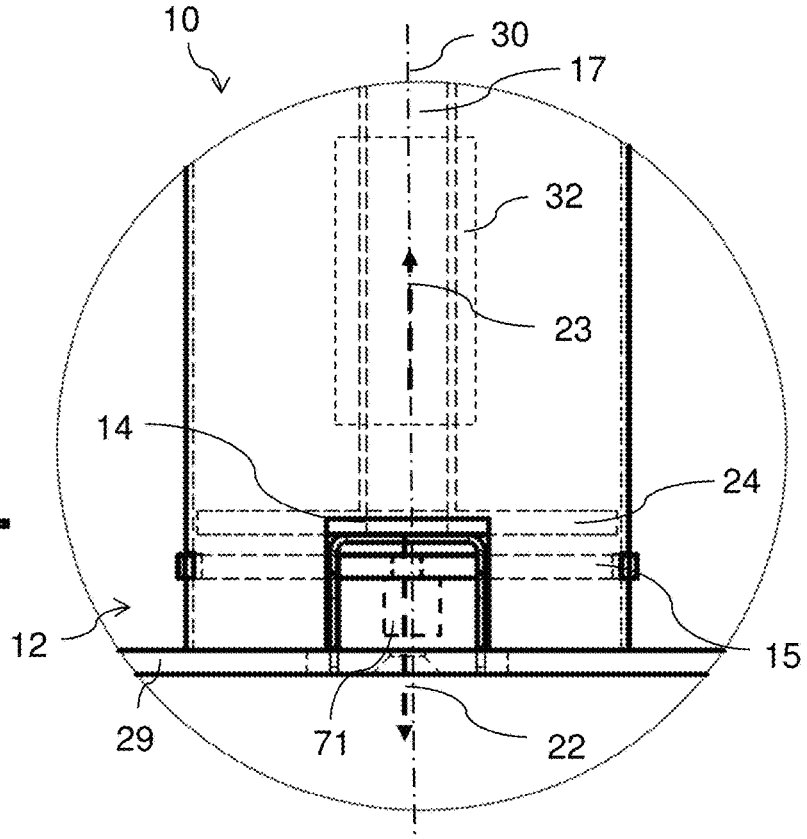
FIG. 10 is an enlargement of the lower part of the device shown in FIG. 8.

The mechanical construction of the different types of connected liquid dispensers is first described in FIGS. 8 to 11. Next, means of transmitting information representative of the movement of the pedal are described. FIGS. 8 to 10 show the elements already described above, with the same numerical references.

Figure 11:
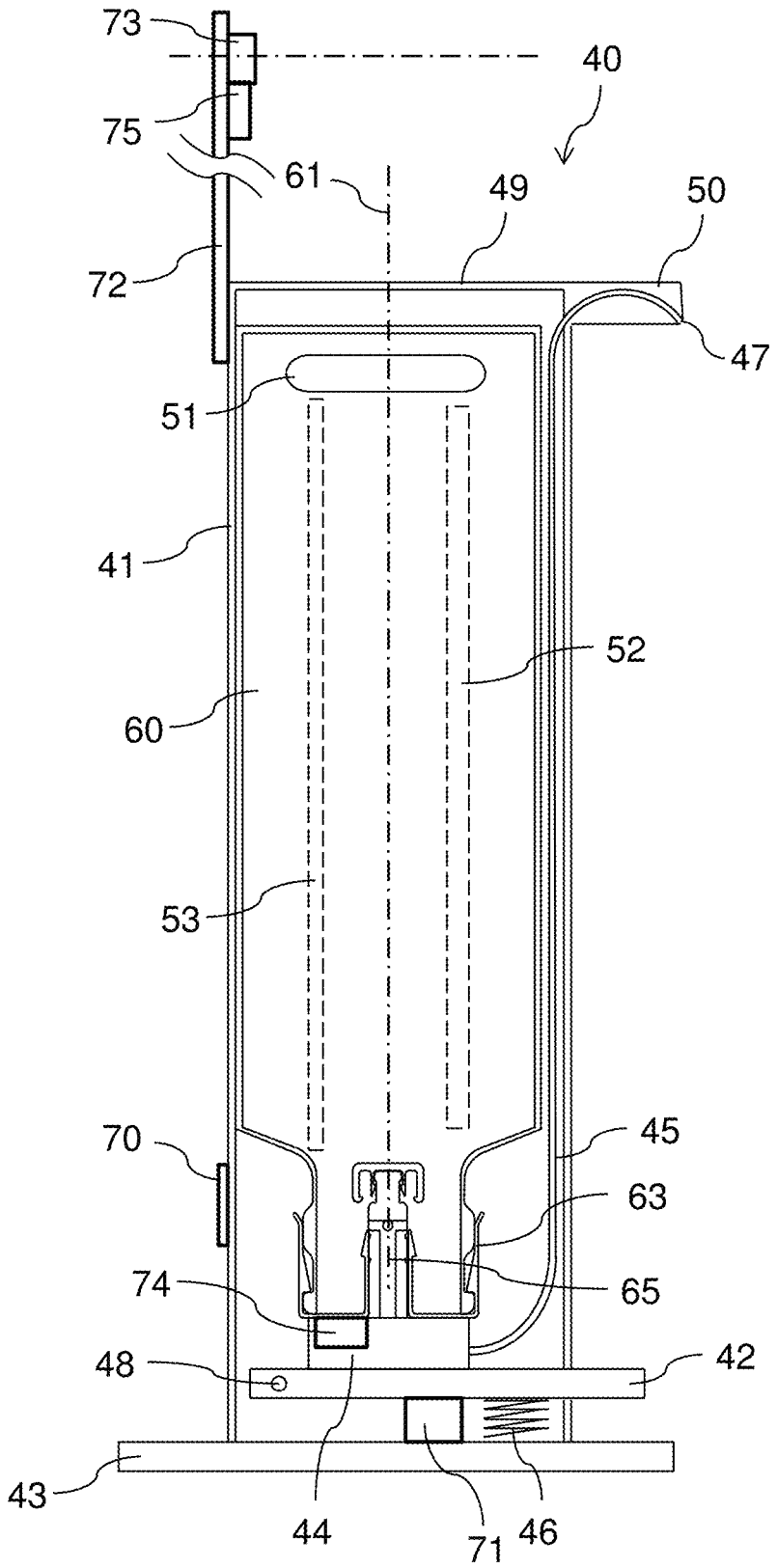
FIG. 11 represents an embodiment a liquid dispensing device.

FIG. 11 shows a liquid dispenser. This device 40 consists of a container 60 and a connector 65. This device also has a ground support plate 43. In some variants, the plate provides a means of anchoring to a wall or to the floor and wall.

The device 40 comprises a body 41 supported by the plate 43 comprising, in the lower part, a pedal 42 for actuating a pump 44 connected, on the one hand, to the liquid tank 60 via connection 65 and, on the other hand, to a pipe 45 for pumped liquid, the pipe leading to a delivery port 47 in the upper part of the body 41. Port 47 is preferably surrounded by a rigid part 50 to prevent a user from deforming pipe 45. A spring 46 ensures that the pedal 46 is lifted up. A shaft 48 allows the rotation of the pedal 42 when a user presses down with his foot.

The pump 44, of known type, ensures the pumping in any tank, through any connection.

The 41 body connects a low part at a user's foot height to a high part at a user's hand height. The lower part has an actuating pedal 42 extending outside the body 41 to receive the vertical downward action (from top to bottom in FIG. 11)

of a user's foot and extending inside the body 41 to the horizontal axis of rotation 48.

As can be understood, the dispenser device 40 is completely mechanical and does not require any power source. In addition, the user does not have to touch the device 40 except with the foot that operates the pedal 42. Therefore, there is no risk of contaminating the device 40 during use. Because of its weight and size, device 40 cannot be tampered with, in particular if it is fixed to the floor or wall.

Preferably, the upper part 49 of the body 41 is removable, to give access to the inside of the body 41 and to change the container 60, and provided with a locking means (not shown). This locking means can be a nut, lock or padlock, for example. Thus, on the one hand, the public cannot access and steal container 60, but on the other hand, an operator can easily replace an empty container 60. In particular, preferably, tank 60 is fitted with a handle 51, for example moulded, on the side opposite the mouth of tank 60. Preferably, vertical rails 52 form guides so that the central opening of the cap 63 is coaxial with the fitting 65 when the operator slides a full tank into the body 41. In embodiments, body 41 has a port 53 opposite tank 60. An operator can thus see the filling level of tank 60. Preferably, the port 53 is closed with a glass pane or is not on the side of the pedal 42, e.g. it is offset by at least one third of the circumference of body 41, in order not to encourage a child to put his fingers in it.

In embodiments (not shown), the plate 43 has floor fixing elements. These fastening elements are, for example, conical screw head housings. By means of these arrangements, the device 40 can be made immovable and therefore unremovable.

Preferably, device 40 has a larger dimension, its height being between 90 cm and 110 cm. Thus, the liquid is delivered through port 47 at the height of one hand of a substantially horizontal arm for the average height of adults and adolescents. In embodiments, the body 41 is cylindrical and closed outside the pedal passage opening 42 and the pipe passage opening 45.

We will now describe means of transmitting information representative of movement of the pedal or pedal pressure 14 or 42. This information may be received by a means of access (not shown) to a space or room, by a means of statistical processing, e.g. for the purpose of determining whether the liquid container needs to be recharged or replaced.

In a first (non-represented) embodiment, the means of transmission of information representative of pedal 14 or 42 depression is passive, i.e. it does not comprise a power source. For example, this means consists of a dry contact which changes state with the movement of the pedal. This dry contact, connected in series with an electric striker, for example, prevents the opening of a door locked by such an electric striker as long as both the pedal has not been depressed and the control for opening the striker, e.g. a push button, an electronic tag reader (e.g. Vigik, registered trademark), a smartphone recognition or a digicode (registered trademark), has not been triggered. A time delay may allow these two actions to be performed successively within a limited time interval, for example fifteen seconds. For example, a room that is already protected by an electric strike can easily be equipped with a liquid dispenser.

In a second embodiment (not shown), the means of information representative of pedal 14 or 42 depression comprises an electric power generator. For example, this generator is a piezoelectric crystal deformed by the pedal pressure. This generator powers for a few seconds a circuit for emitting a signal transmitted in a wired or unwired manner. This signal is, for example, a code assigned to the liquid dispenser. As indicated above, this signal is used to disable access to a space or room. In other words, access to the space or room is again inhibited a few seconds (e.g. fifteen) after this signal is received and remains inhibited until the signal is received again.

In a third embodiment, the means of information representative of pedal 14 or 42 depression comprises a permanent source of electrical energy and/or electrical energy storage 71, e.g. a battery or accumulator battery. The source of energy may be mains power or a solar panel, for example. A sensor, e.g. a switch or microswitch (reed switch), built into the storage circuit 71 detects the depression of pedal 14 or 42. A coding circuit built into the storage circuitry 71 transmits a coded signal as soon as the pedal 14 or 42 is depressed, either wired or unwired, as soon as the pedal is depressed. In FIGS. 8 to 14, an antenna 70 is used to transmit this code. This transmission can be carried out according to a Bluetooth, NFC, RFID or Wifi or GSM (registered trademarks) protocol, for example. Circuit 71 preferably comprises a means of transmitting information representative of the liquid level in tank 19 or 60. This level is determined by circuit 71 by counting the number of times the pedal 14 or 42 has been depressed from the supply or by a pressure or force sensor 74 positioned in a support of the tank 60. The means of transmitting information representative of the level of liquid in tank 19 or 60 only transmits this information when the estimated level is below a predetermined value, e.g. one tenth of the maximum level, or equivalent to a predetermined number of days of liquid consumption, the average daily consumption being measured in the same way on the device (counting of pedal strokes or weight measurement). In other words, the means 71 for transmitting information representative of the liquid level in tank 19 or 60 is configured to measure a daily average consumption of liquid, the predetermined level value, which triggers the transmission, being this daily average consumption multiplied by a predetermined number of days.

Figure 12:
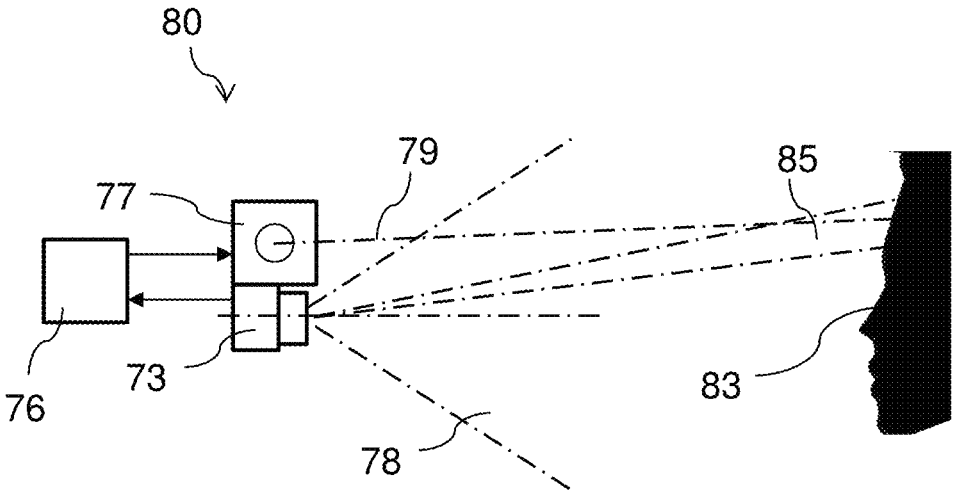
FIG. 12 represents a front temperature measuring system integrated in variants of the embodiment shown in FIG. 11.
Figure 13:
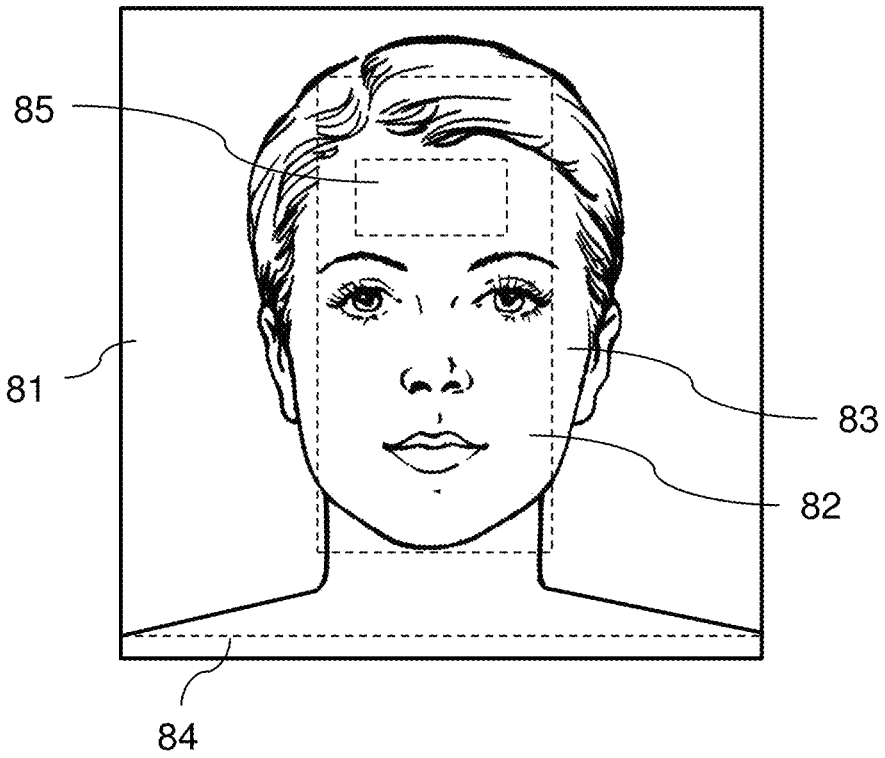
FIG. 13 represents a frontal zone for taking the temperature with the measuring system shown in FIG. 12.

In the embodiment illustrated in FIG. 11, the device 40 additionally comprises a sensor 73 of the user's body temperature, for example a thermal camera or a system as described opposite FIGS. 12 and 13, supported at medium height of the users' heads by an arm 72 connected to the body 41. This temperature sensor 73 estimates the temperature of the user's forehead and transmits it to circuit 71. In case this temperature is higher than a predetermined value, for example 38° C., an alert or alarm is transmitted to this user (for example with a light 75 changing from green to red or a vocal message) and/or remotely, for example to inhibit access to a room or space. For example, the parts of device 40 are made of brushed stainless steel. This device 40 is self-stabilised, vandal-proof and highly resistant.

For example, the dimensions of device 40 are:

Height: 1700 mm (including support 72)

Height: 1000 mm (excluding support 72)

Body diameter: 250 mm

Diameter of the plate 43: 450 mm

Maximum tank width, e.g., diameter: 230 mm

Maximum container height: 900 mm

FIG. 12 shows a front-end temperature measurement system 80 integrated in variants of the device 40. FIG. 13 shows part of an image of a face captured by camera 73.

This system 80 consists of camera 73, an image processing module 76 and a motorized temperature sensor 77. The field of view 78 of camera 73 allows a user to position his or her face in front of camera 73. For example, a visible message on the device 40 prompts the user to stand straight in front of the camera. Alternatively, a visual guide, such as a mirror, allows the user to verify that his or her face 83 is approximately horizontally centered in the field of view 78. The image processing module 76 extracts an area 85 of the user's forehead from the captured image. Various image processing techniques can be used by the image processing module 76, including techniques from facial recognition systems or from the focus ("autofocus") systems of cameras and mobile communicating devices, such as smartphones. A simplified example of image processing and position control of the motorized temperature sensor is given below 77. First, contours are extracted and compared with stored contours from an image without a user in front of the camera 73. The user's face is then checked to ensure that it is correctly centered horizontally by recognizing shoulders and a head in the contours that are the most different from the stored contours. If the user is not correctly positioned, he is asked to position himself better (by means of an audible and/or visual message). Then, a vertical zone 82 is extracted from the image, zone 82 passing through the user's horizontally centred face. This zone 82 has a width proportional (for example a quarter) to the width of the previously marked shoulders. This area 82 has a height proportional (for example twice) to the width and extends above line 84 of the previously marked shoulders. In this zone 82, the chin, mouth, nose and eyes are searched for by their shadows and contours and/or around their presumed predetermined position. Once these organs have been identified, an area 85 is determined, below the hair, which is identified by its high contour density, and above the eyes.

Once the frontal area 85 of the face has been located, the image processing module controls the angular motor of the motorised temperature sensor 77 to orient the measurement area towards the forehead, preferably taking into account the parallax linked to the offset between the optical axis of camera 73 and the axis of rotation of the temperature sensor, given that the measurement of the dimension of face 83 in the captured image is representative of the distance between this face 83 and the optical center of the lens of camera 73. Depending on the variants, the temperature sensor 77 is motorized to perform a single rotational movement around a horizontal axis or is motorized to perform, in addition, a rotation around a vertical axis.

The temperature sensor 77 is equipped with a lens for focusing light rays in the infrared thermal range around an axis 79 and an electronic sensor of a type known from non-contact thermometers that receives the focused rays. Depending on the measured temperature, the dispenser 40 may or may not allow access to the room. For example, if the measured temperature is higher than 37.8° C., access is denied.

Figure 14:
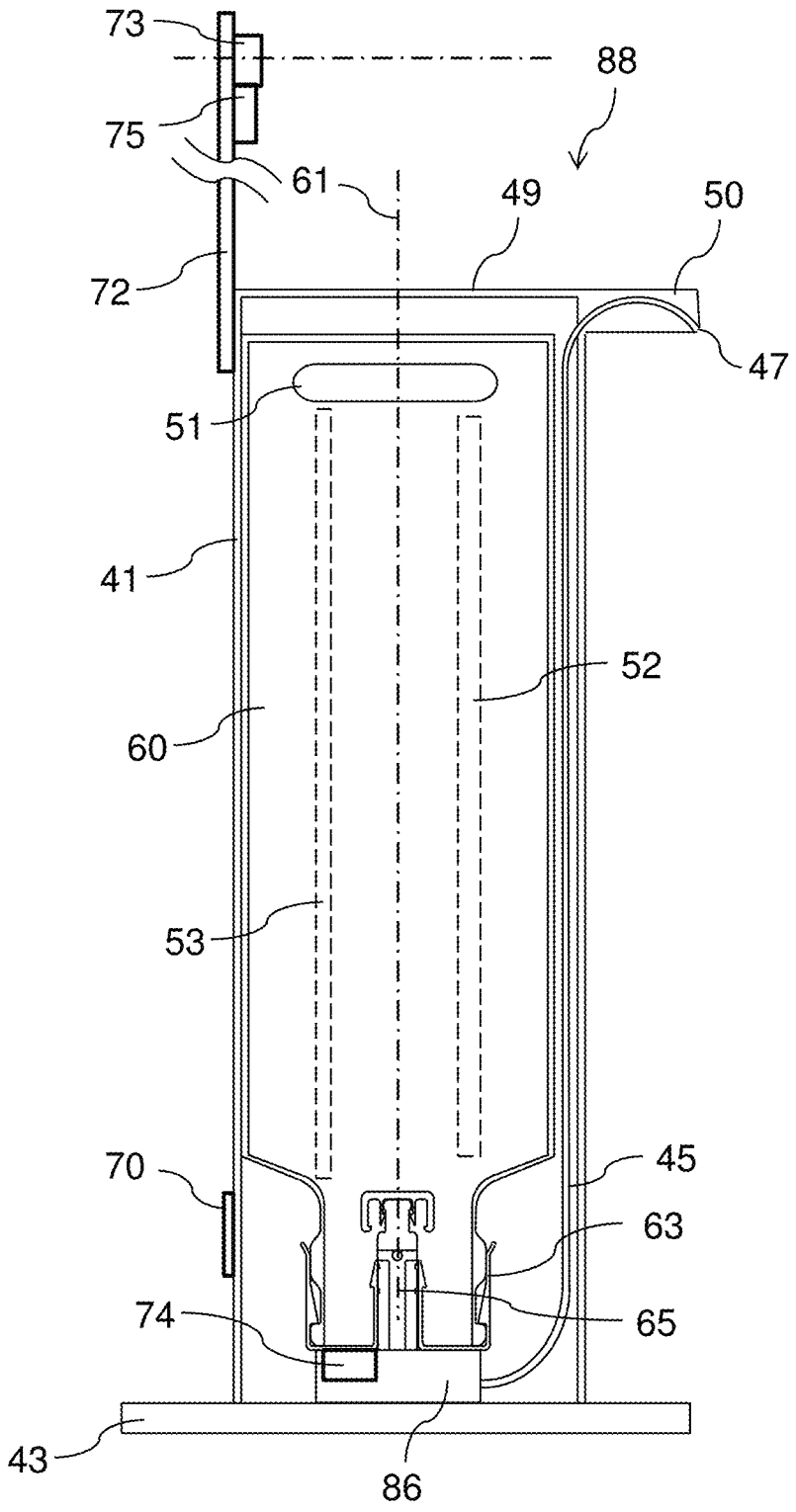
FIG. 14 represents an embodiment of an automatic liquid or gel dispensing device.
Figure 15:
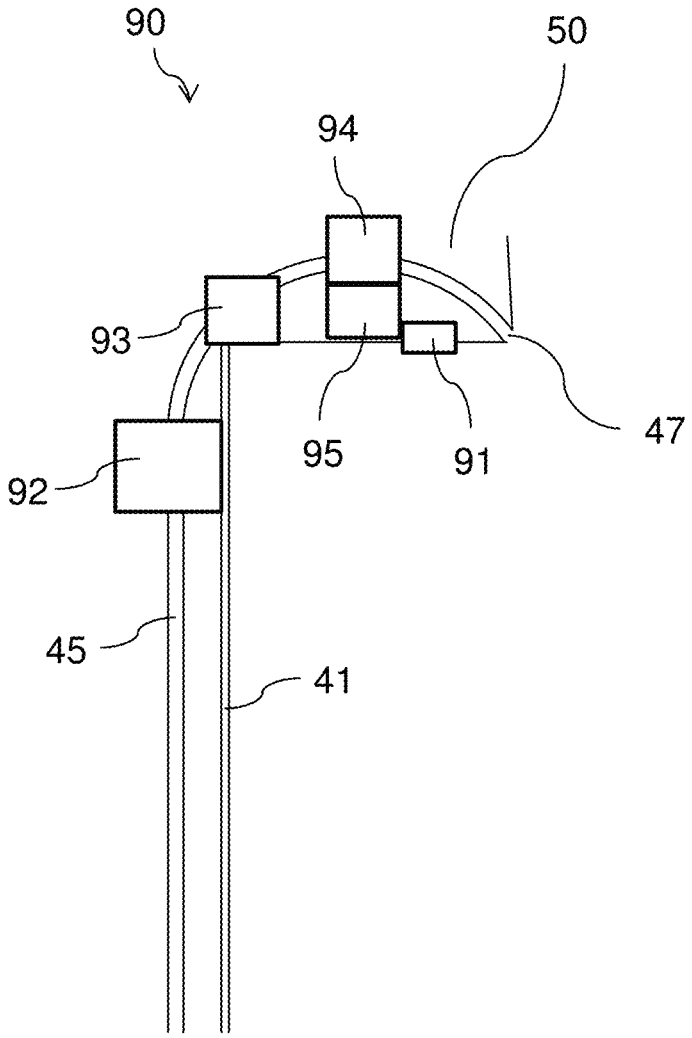
FIG. 15 is a part of the device shown in FIG. 14.

Below is a description of an automatic liquid dispensing device in which the lower part, without pedal or pump 44, is simplified, as shown in FIGS. 14 and 15. In FIGS. 14 and 15 an automatic liquid dispensing device 88 similar to the device 40 shown in FIG. 11, except that the foot pedal 42 is replaced by an electric pump 86 and an automatic dispensing system 90 is mounted on line 45. The system 90 consists of:

- a pump 92 on line 45, configured to pump the liquid from tank 60,
- a bag 93 of liquid pumped under pressure, downstream, on line 45, of the pump 92,
- a electric valve 94 downstream of bag 93, followed by liquid ejection opening 47,
- a sensor 91 for detecting the presence of a hand in the axis of the ejection opening 470 and
- a circuit 95 for controlling the electric valve 94, which opens the electric valve for a first predetermined time after the detection of a hand by the sensor 91, and for controlling the pump 92 for a second predetermined time after the detection of a hand by the sensor 91.

It is noted that if the wall of the tank 60 is rigid, preferably a top opening, e.g. half a millimeter in diameter, is provided in the tank 60 so that air can enter the tank 60 as the liquid is pumped by the pump 92.

Pump 92 is of a known type, e.g. peristaltic. The pressurized liquid bag 93 is made of a stretchable material, e.g. silicone or rubber. The "useful" volume of bag 93 is the maximum volume that can be dispensed by a drop in its internal pressure without refilling by pump 92. It is the difference in volume of bag 93 between its volume under pressure and its volume if the electric valve is permanently open. In embodiments, this useful volume is less than 12 ml.

The electric valve 94 is preferably "all or nothing". The sensor 91 for detecting the presence of a hand in the axis of the ejection opening 47 is, for example, a photocell, an infrared radiation detector, a capacitive sensor or a transceiver for sound, light or electromagnetic radiation. The control circuit 95 for the electric valve 94 and the pump 92 is, for example, a microcontroller card.

The first predetermined time t1 is, for example, between a quarter and half a second. The second predetermined time t2 is, for example, two seconds. It corresponds to the pumping of one dose of liquid to be dispensed per user. Preferably, the second predetermined pump operating time is set to complete the filling of the bag in less than two seconds after a first predetermined time of opening the electric valve.

Preferentially, the control circuit 95 comprises means for estimating the pressure in the pressurized bag and/or the useful volume of liquid available in the pressurized bag, and the control circuit 95 determines the first predetermined duration according to a decreasing function of the estimated pressure in the pressurized bag and/or of the useful volume.

For example, the control circuit 95 estimates:

- the pressure P in the pocket 93 under pressure as inversely proportional to the effective volume V of liquid available in the pocket (with a proportionality coefficient r),
- the flow rate d1 in electric valve 94 as proportional to the pressure P in the pocket (with proportionality coefficient k),
- the flow rate d2 in pump 92 as a constant value when the pump is operated.

In stationary operation, i.e. when the time between two openings of electric valve 94 is greater than the second predetermined time t2, we have ("·" being the sign of the multiplication)

$$d2\cdot t2-d1\cdot t1=0 \text{ and } d1=kP \text{ so } P=d2\cdot t2/(k\cdot t1) \text{ and } V=P/r=d2\cdot t2/(r\cdot k\cdot t1)$$

The volume Vd of liquid dispensed during the opening of electric valve 94 and the activation of pump 92 is equal to $$\mathrm{Vd}=d1\cdot t1=k\cdot P\cdot t1=k\cdot r\cdot V\cdot t1.$$

Knowing this volume Vd to be dispensed and the first predetermined duration t1, in stationary state, the useful volume V of pocket 93 is determined in stationary state. V=Vd/(k·r·t1). When the system is initialized, the pump is operated for a period of time corresponding to this useful volume, i.e. for a period of time during which the volume required to start pressurizing bag 93 plus the volume V=Vd/(k·r·t1) is delivered.

When the dispensing system is no longer in stationary operation, i.e. when the time between two hand detections by the sensor 91 is less than the second predetermined time t2, the control unit 95 determines the drop in volume between the two successive openings of the electric valve 94 and then, as a function of this drop in volume, the drop in pressure in the bag 93 and the increase in the first predetermined opening time of the electric valve 94 necessary to deliver the volume Vd of liquid to be dispensed. The control unit 95 then keeps the pump 92 activated until the volume in steady state is obtained again. More generally, the control circuit 95 determines the first predetermined time according to a decreasing function of the estimated pressure in the pressure bag and/or the useful volume.

Preferably, device 88 also comprises a means of transmitting information representative of the opening of the electric valve, equivalent to the means of transmitting information representative of the pedal pressure explained above in FIGS. 8 to 11, and having the same consequences on access to a place.

Preferably, and as explained above in relation to FIGS. 8 to 11, device 88 comprises a means of transmitting information representative of the liquid level in the container. For example, this means of transmission counts the number of electric valve openings from the supply. In another example, the means 71 for transmitting information representative of the level comprises the pressure or force sensor 74 positioned in a support of the tank 60.

In embodiments, the means 71 for transmitting information representative of the liquid level in tank 60 is configured to transmit this information only when the estimated level is below a predetermined value. For example, the means for transmitting information representative of the liquid level in tank 60 is configured to measure an average daily consumption of liquid, the predetermined value being this average daily consumption multiplied by a predetermined number of days for a routine replenishment intervention.

The device for accessing a location corresponding to the device shown in FIGS. 8-15 comprises a receiver for information representative of the opening of the electric valve and means for inhibiting an access actuator configured to disable the actuator for a predetermined period of time following the opening of the electric valve.

Figure 16:
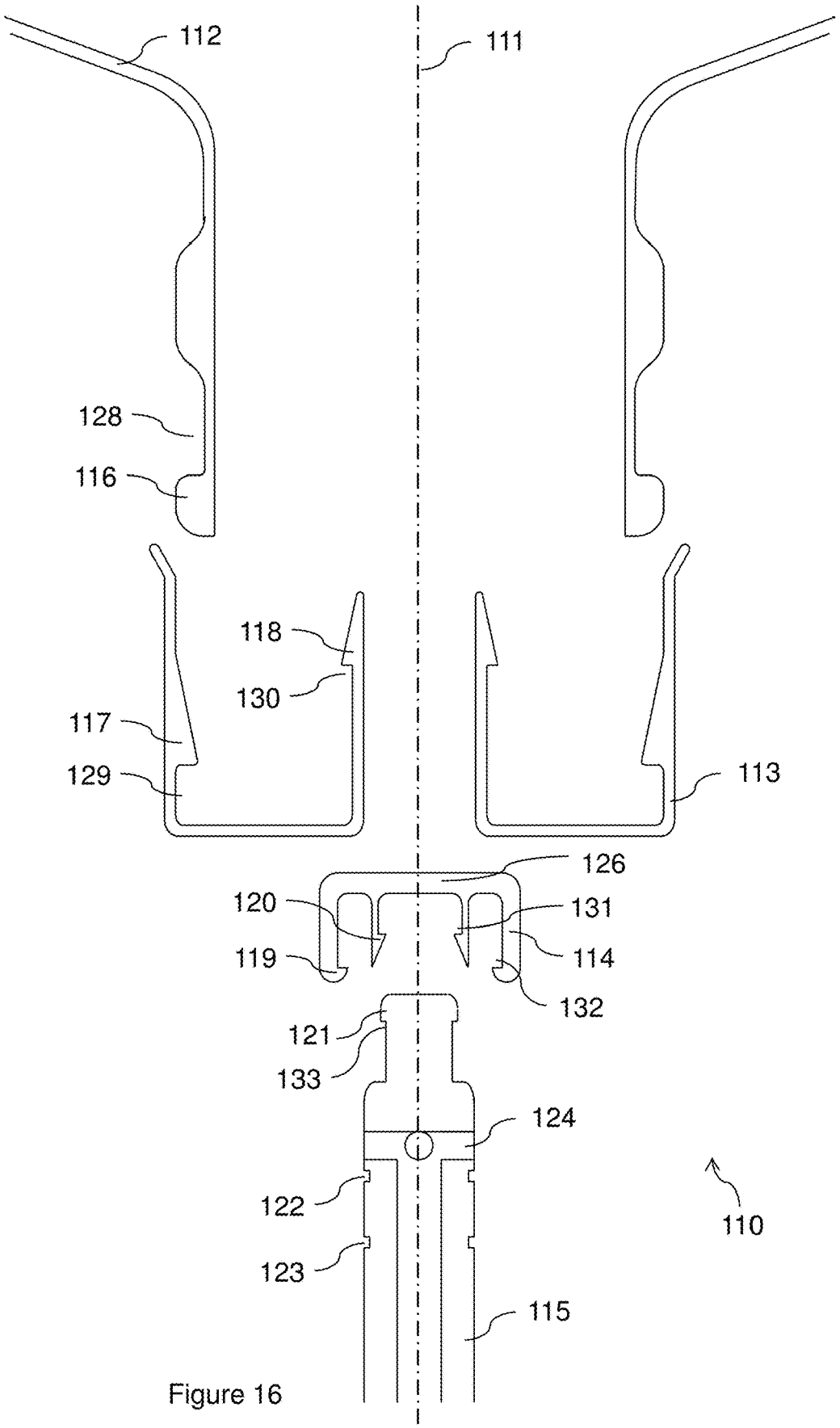
FIG. 16 shows, in vertical axial section, a tank mouth, two tank closures and a pump connection.

In FIGS. 16 to 19, a container 110 comprising a container 112 (partially shown), a cap 113 and a plug 114 is observed. A valve port 115 is also partially shown. A vertical axis 111 corresponds to the translation axis of port 115 in a central opening of plug 113. All the elements shown in FIG. 16 are rotationally symmetrical about axis 111, except for the four cylindrical side openings 124 oriented perpendicular to axis 111 and symmetrical to axis 111 of port 115.

In other embodiments, these parts are not rotationally symmetrical.

Figure 17:
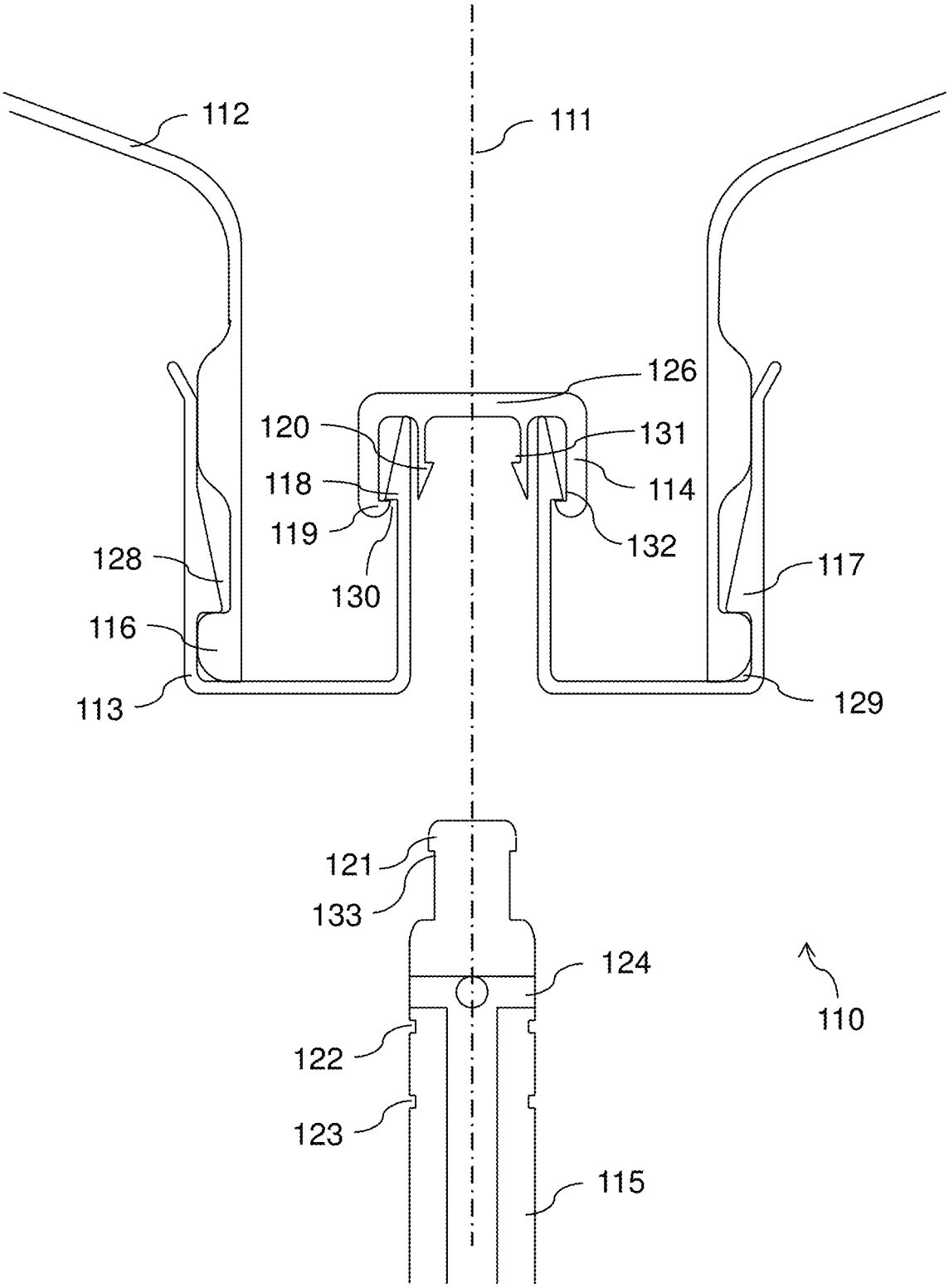
FIG. 17 shows, in vertical axial section, the elements shown in FIG. 16 when the tank is assembled with the closure parts.

When container 112, cap 113 and shutter 114 are assembled and not connected to a dispenser, as shown in FIG. 17, the cap and shutter make container 110 hermetic, except for a micro-opening at the top (the topmost one in the configuration shown in the figures) to allow air to enter as container 110 empties of its contents, gel or liquid. The cap 113 has a first part 118, 130 of a first means of retaining the plug 114. The plug 114 has a second part 119, 132 of the first retaining means, complementary to the first part of the first retaining means.

In the embodiment shown in FIGS. 16 to 19, 130 is an outer housing for an inner tooth 119 and 132 is an inner housing for an outer tooth 118.

The obturator 114 has, in addition to a first part 120, 131 of a second retaining means on a head of the coupling 115. Fitting 115 has a second part 121, 133 of a second retaining means complementary to the first part of the second retaining means.

In the embodiment shown in FIGS. 16 to 19, 133 is an outer housing for an inner tooth 120 and 131 is an inner housing for an outer tooth 121.

The first retainer 118, 130, 119, 132 and the second retainer 120, 131, 121, 133 are configured:

- to engage and disengage by translation along the translation axis 111,
- so that the engagement force of the second restraining means is less than the disengagement force of the first restraining means, and
- so that the engagement force of the first means of restraint is less than the disengagement force of the second means of restraint.

To configure the restraint means, one skilled in the art can vary the shapes, materials and thicknesses of the restraint means.

In the embodiment shown, the shapes of the means of restraint are configured to perform the three functions stated above. The realization of the means of restraint is easy and low cost.

In embodiments, including the one shown, at least part of at least one means of restraint (the two means of restraint in the figures) has at least one tooth 118, 119, 120 and 121 with an edge perpendicular to the axis of translation 111. Each tooth 118 to 121 has a smaller angle to the translation axis 111 on the side of the tooth serving for engagement (upper side for teeth 118 and 121 and lower side for teeth 119 and 120) than on the side of the tooth serving for disengagement (lower side for teeth 118 and 121 and upper side for teeth 119 and 120).

In embodiments, including the one shown, at least one part of at least one retaining means (both retaining means in the figures) comprises a tooth with a frustoconical face. These are teeth 118 and 120 in the embodiment shown. This truncated cone facilitates the engagement of the retaining means.

In embodiments, including the one shown, at least part of at least one retaining means (the two retaining means in the figures) comprises a tooth one face of which is substantially in a plane perpendicular to the axis of translation. In the figures, these are the upper faces of teeth 119 and 120 and the lower faces of teeth 118 and 121. In practice, these planes are slightly deformed into cones, making it very slightly easier to disengage the teeth. This practically planar conical face increases the force required to disengage the retainer.

In embodiments, including the one shown, at least part of at least one retaining means (both retaining means in the figures) has a tooth with a truncated torus on one side. In the figures, this is the upper face of tooth 121, quarter toroidal, and the lower face of tooth 119, half toroidal. This torus facilitates the engagement of the retainer.

In embodiments, including the one shown, at least part of a retainer (both retainers in the figures) has a housing for one tooth. In the figures, these are housings 130 to 133.

In unrepresented embodiments, at least one retaining means operates by friction on smooth or preferably rough, possibly granular surfaces. In unrepresented embodiments, at least one internal tooth is replaced by an external tooth, and/or vice versa, and at least one internal housing is replaced by an external housing, and/or vice versa.

Figure 18:
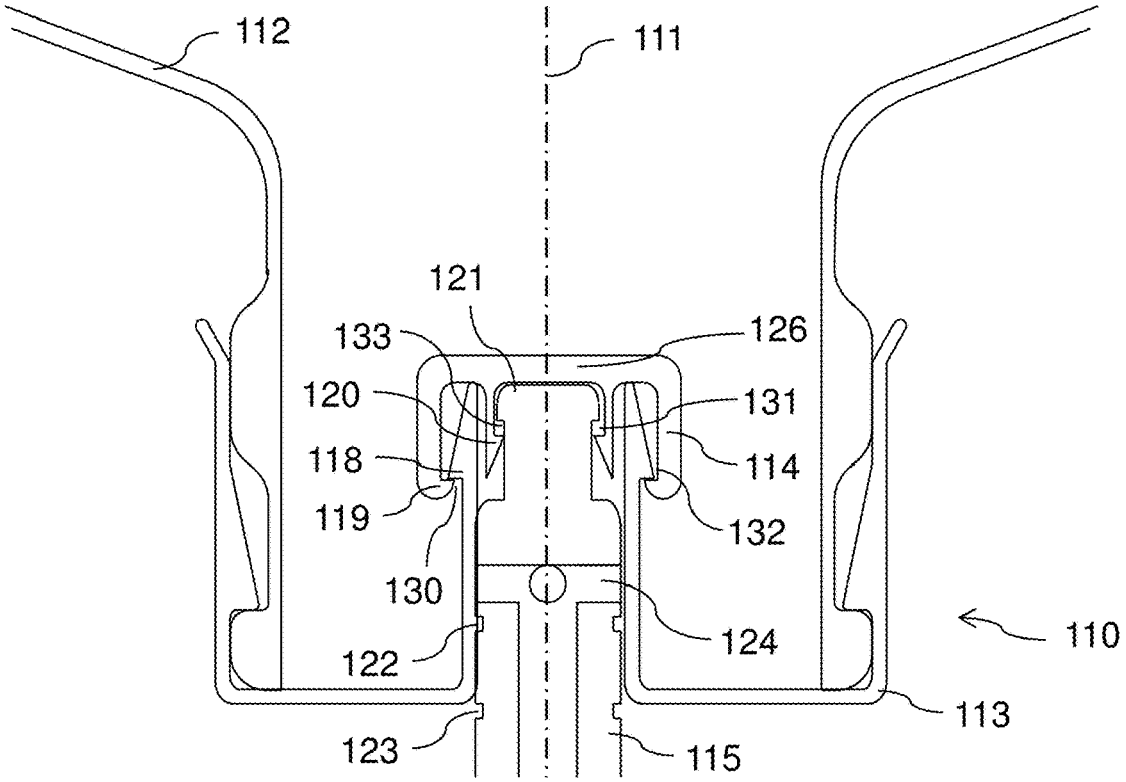
FIG. 18 shows, in vertical axial section, the elements illustrated in FIGS. 16 and 17 when the tank is being installed on the pump connection
Figure 19:
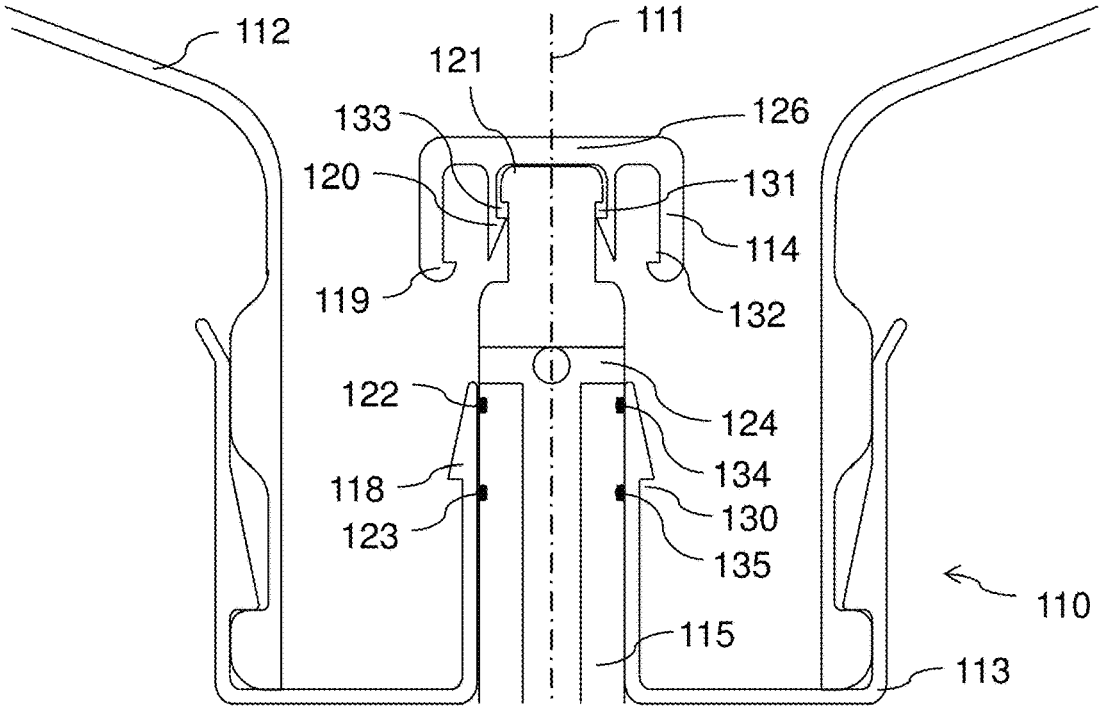
FIG. 19 shows, in vertical axial section, the elements illustrated in FIGS. 16 to 18 when the tank is in operating position.

When tank 110 is filled, for transport or before it is mounted on the distributor connection 115, as shown in the upper part of FIG. 17, the valve 114 is fixed on the cap 113 and tank 110 is hermetically sealed. When the tank 110 is mounted on the valve fitting 115, the valve fitting 115 engages in the center passage of cap 113 and then the valve plug 114, as shown in FIG. 18. Continuing its movement relative to tank 110, fitting 115 pushes against the bottom 126 of valve plug 114 and disengages valve plug 114 from cap 113 by continuing to move through the cap passage parallel to the axis 111, as shown in FIG. 19. The side openings 124 of port 115 are then in communication with the interior of container 112 and the contents of container 112 can flow or be pumped through port 115 for dispensing by a liquid or gel dispenser.

When the container is to be removed from the dispenser, even when partially or completely full, by sliding port 115 in the opposite direction (downward in the figures), the valve plug 114 engages with cap 113, as shown in FIG. 18, and then port 115 disengages from valve plug 114, as shown in FIG. 17. Tank 110 is then sealed again and can be removed from the valve. In addition, if the tank is to be refilled, the mouth of container 112 has to be moved upwards and the plug 114 has to be separated from the cap 113, so that the plug 114 falls into container 112 and does not re-engage with the cap 113. Traceability of the contents of container 110 can therefore be ensured.

In embodiments, including that shown, the mouth of container 112 has a first part 116, 128 of a third retaining means and the cap 113 has a second part 117, 129 of the third retaining means complementary to the first part of the retaining means. What is described above with respect to the first and second retaining means is valid for the third retaining means, except that the third retaining means is not intended to be disengaged, at least not during the relative movement of the coupling 115 and the tank 110.

The present invention also relates to the distributor fitting 115 for assembly with a tank which is a subject of the invention. This connector comprises a part of the second retaining means, at least one joint 134, 135 in a joint housing 122, 123, and at least one channel, or opening 124 for the passage of gel or liquid, which channel opens between the part of the retaining means and the joint.

The present invention also relates to a device for dispensing gel or liquid, which comprises a fitting which is the subject of the invention and/or a tank which is a subject of the invention, such as the devices illustrated in FIG. 11 or 14.

The invention claimed is:

1. A device for dispensing gel or sanitary liquid, that comprises:

a cylindrical body extending between a bottom portion and a top portion;

an actuating pedal rotatably mounted on the bottom portion of the cylindrical body, and being configured for rotation about an axis of rotation and having an inner part disposed inside the bottom portion of the cylindrical body and an outer part disposed outside said cylindrical body and wherein the axis of rotation is defined between said inner part and said outer part such that when outer part of the pedal is pressed down, the inner part moves up inside said cylindrical body towards the top portion;

a tank support disposed inside the top portion of the cylindrical body, and being configured for receiving a gel or liquid container which includes a head having a pump, said tank support is configured for upward movement when the pedal is pressed, and is selectively shifted between an upper position when said pedal is pressed and a lower position when said pedal is released;

a removable stopper mounted at the top portion and being configured for engaging the container head when said tank support is in its lower position such that when said tank support moves upwardly the container head is maintained engaged with said removable stopper and the upward movement of the tank support and the container actuates the pump which pressurizes the gel or liquid inside the container and causes a portion of this gel or liquid to be expelled, said removable stopper is equipped with locking means;

wherein the cylindrical body includes sliding guide for facilitating sliding of the tank support inside the cylindrical body, and wherein said cylindrical body includes a wall which holds the container with the container head held engaged against the removable stopper in either the upper position and lower position of the tank support, this wall and the removable stopper together preventing the container from being removed, and wherein the locking means are configured for unlocking of the removable stopper enabling the replacement of the container.

2. The device according to claim 1, that comprises a piston provided with a lower part in the form of a piston guide and configured to slide on the inner wall of the cylindrical body.

3. The device for dispensing gel or liquid according to claim 1, wherein the cylindrical body has a lateral opening around the removable stopper, configured to allow several fingers of a user to pass under a spout of the gel or liquid container.

4. The device for dispensing gel or liquid according to claim 1, wherein the piston or rod has a means of adjusting the piston or rod length between the pedal and the tank support.

5. The device for dispensing gel or liquid according to claim 4, wherein the adjusting means is a combination of a screw associated with one part of the piston or rod and a thread formed in another part of the piston.

6. The device for dispensing gel or liquid according to claim 4, wherein the adjusting means comprises a key carried by one part of the piston or rod, which penetrates into one of a plurality of orifices carried by another part of the piston at different distances from one of its ends.

7. The device for dispensing gel or liquid according to claim 4, wherein the adjusting means comprises means for restraining the movement of the piston or rod in its direction of movement towards the container by pinching a rod or linkage of the piston or rod.

8. The device for dispensing gel or liquid according to claim 1, wherein the cylindrical body has an opening facing the space for receiving a gel or liquid container.

9. The device for dispensing gel or liquid according to claim 1, wherein the piston or rod has a position indicator visible from outside the device.

10. The device for dispensing gel or liquid according to claim 1, that has a larger dimension of between 90 cm and 110 cm.

11. The device for dispensing gel or liquid according to claim 1, wherein the cylindrical body includes passage opening for the pedal and a delivery opening for the gel or liquid and wherein the cylindrical body is closed outside the pedal passage opening and the delivery opening.

12. The device for dispensing gel or liquid according to claim 1, which further comprises a temperature sensor supported at the average height of user's head by an arm connected to the body, this temperature sensor being configured to estimate the temperature of the user's forehead, and a circuit configured to, in the event that this temperature is higher than a predetermined value, transmit an alert or alarm.

13. The device for dispensing gel or liquid according to claim 1, which further comprises a means for transmitting information representative of a movement of the pedal.

14. A device for access to a place, which comprises a device for dispensing gel or liquid according to claim 13, a receiver of information representative of the movement of the pedal, and means for inhibiting an access actuator configured to disable the actuator for a predetermined period of time following the movement of the pedal.

* * * * *